US006830434B2

(12) United States Patent
Kondo et al.

(10) Patent No.: US 6,830,434 B2
(45) Date of Patent: Dec. 14, 2004

(54) COOLING FAN

(75) Inventors: Hiroyuki Kondo, Toyoake (JP); Youji Sato, Seto (JP)

(73) Assignee: Aisin Kako Kabushiki Kaisha, Aichi-ken (JP)

( * ) Notice: Subject to any disclaimer, the term of this patent is extended or adjusted under 35 U.S.C. 154(b) by 73 days.

(21) Appl. No.: 10/286,958

(22) Filed: Nov. 4, 2002

(65) Prior Publication Data

US 2003/0086787 A1 May 8, 2003

(30) Foreign Application Priority Data

Nov. 5, 2001 (JP) ..... 2001-339146

(51) Int. Cl.[7] ..... F04D 29/60

(52) U.S. Cl. ..... 416/169 A; 416/229 R; 416/234; 416/241 A

(58) Field of Search ..... 416/169 A, 241 A, 416/229 R, 230, 234

(56) References Cited

U.S. PATENT DOCUMENTS 2,698,128 A * 12/1954 Ault et al. ..... 417/353
4,153,389 A * 5/1979 Boyd ..... 416/169 A
4,169,693 A * 10/1979 Brubaker ..... 416/169 A
4,451,202 A * 5/1984 Hauser ..... 416/214 R
4,930,990 A * 6/1990 Brackett ..... 416/238
5,066,196 A * 11/1991 Morofushi ..... 416/214 A
5,193,981 A * 3/1993 Scheidel et al. ..... 416/169 A
5,577,888 A * 11/1996 Capdevila et al. ..... 416/238
6,010,305 A * 1/2000 Hauser ..... 416/169 A

FOREIGN PATENT DOCUMENTS

EP 463385 A2 * 1/1992 ..... F04D/29/32

* cited by examiner

*Primary Examiner*—Edward K. Look
*Assistant Examiner*—Igor Kershteyn
(74) *Attorney, Agent, or Firm*—Westerman, Hattori, Daniels & Adrian, LLP

(57) ABSTRACT

A cooling fan has a ring-shaped metal spacer, a boss of substantially a cylindrical shape made of a synthetic resin that is molded integrally with the spacer as an insert and lural blades that extend outwardly from the boss. A deep-drawn part is provided on an outer circumferential part of the spacer at an inside of the boss. A thickness of the boss is made large at around a front end side of the blade on which the largest stress is applied. A rib at an inner periphery of the boss at around the front end side of the blade is made thicker than the other ribs. Moreover, an interval between that rib and an adjacent rib is made narrower.

7 Claims, 5 Drawing Sheets

COOLING FAN

BACKGROUND OF THE INVENTION

1. Field of the Invention

This invention relates to a cooling fan for an engine or the like, more particularly to a cooling fan having a metal spacer of a ring shape, a plastic boss of substantially a cylindrical shape that is molded integrally with the spacer as an insert and a plurality of blades that extends outwardly from the boss.

2. Description of the Related Art

A conventional cooling fan has a resin molded portion that is composed of a metal spacer of a ring shape, a plastic boss of substantially a cylindrical shape that is molded integrally with the spacer as an insert and a plurality of blades that extends outwardly from the boss. The conventional cooling fan has no drawn part on an outer periphery of the spacer, so that the spacer lacks in rigidity. Consequently, the conventional cooling fan is deficient in durability and cannot be put into practical use.

In view of the above problem, a part of the spacer was deep-drawn that was inserted into the cylindrical boss of the resin molded portion so as to assure the rigidity of the spacer. Then, sufficient durability was obtained. Moreover, ribs were formed on an inside of the blade of the boss at fixed intervals. Then, strength of the boss improved and the cooling fan had sufficient durability as a whole.

However, where the outer periphery of the spacer is deep-drawn so as to extend up to the boss, an outer diameter of the spacer enlarges thereby to increase production costs. Moreover, where the ribs are provided on the inside of the blade of the boss at constant intervals, the strength may be deficient or an excessive reinforced structure may be obtained depending on the number or shape of the ribs thereby to increase the production costs, too.

BRIEF SUMMARY OF THE INVENTION

An object of the present invention is to provide a cooling fan that is capable of improving durability while limiting a size of an outer periphery of a spacer, a thickness, a size and an arrangement of ribs at an inside of a boss and a thickness of the boss to necessary dimensions thereby to minimize production costs.

According to a first aspect of the invention, there is provided a cooling fan comprising a spacer of a ring shape made of a metal; a boss of substantially a cylindrical shape made of a synthetic resin that is molded integrally with the spacer as an insert; and plural blades that extend outwardly from the boss. The spacer has a deep-drawn part provided on an outer circumferential part thereof at an inside of the boss according to a mounting position of the blade.

According to a second aspect of the invention, there is provided a cooling fan comprising a spacer of a ring shape made of a metal; a boss of substantially a cylindrical shape made of a synthetic resin that is molded integrally with the spacer as an insert; and plural blades that extend outwardly from the boss. The boss has a larger thickness in part at a front edge side of the blade according to a mounting position of the blade.

According to a third aspect of the invention, there is provided a cooling fan comprising a spacer of a ring shape made of a metal; a boss of substantially a cylindrical shape made of a synthetic resin that is molded integrally with the spacer as an insert; plural blades that extend outwardly from the boss; and plural ribs provided on an inner periphery of the boss at intervals in a circumferential direction of the inner periphery of the boss. One or more of the ribs located at around a front edge side of the blade are thicker than other ribs according to a mounting position of the blade.

According to a fourth aspect of the invention, there is provided a cooling fan comprising a spacer of a ring shape made of a metal; a boss of substantially a cylindrical shape made of a synthetic resin that is molded integrally with the spacer as an insert; plural blades that extend outwardly from the boss; and plural ribs provided on an inner periphery of the boss at intervals in a circumferential direction of the inner periphery of the boss. The ribs change heights according to a mounting position of the blade at an outer periphery of the boss.

According to a fifth aspect of the invention, there is provided a cooling fan comprising a spacer of a ring shape made of a metal; a boss of substantially a cylindrical shape made of a synthetic resin that is molded integrally with the spacer as an insert; plural blades that extend outwardly from the boss; and plural ribs provided on an inner periphery of the boss at intervals in a circumferential direction of the inner periphery of the boss. The interval between the ribs at a front edge side of the blade is narrower than the interval between the ribs at a side away from the front edge side of the blade according to a mounting position of the blade.

According to a sixth aspect of the invention, there is provided a cooling fan comprising a spacer of a ring shape made of a metal; a boss of substantially a cylindrical shape made of a synthetic resin that is molded integrally with the spacer as an insert; plural blades that extend outwardly from the boss; and plural ribs provided on an inner periphery of the boss at intervals in a circumferential direction of the inner periphery of the boss. The cooling fan further comprises two or more of following features: the spacer having a deep-drawn part provided on an outer circumferential part thereof at an inside of the boss, the boss having a larger thickness in part at a front edge side of the blade according to a mounting position of the blade, one or more of the ribs located at around a front edge side of the blade being thicker than other ribs according to a mounting position of the blade, the ribs changing heights according to a mounting position of the blade at an outer periphery of the boss and the interval between the ribs at a front edge side of the blade being narrower than the interval between the ribs at a side away from the front edge side of the blade according to a mounting position of the blade.

Further objects and advantages of the invention will be apparent from the following description, reference being had to the accompanying drawings, wherein preferred embodiments of the invention are clearly shown.

DETAILED DESCRIPTION OF THE INVENTION

Figure 1:
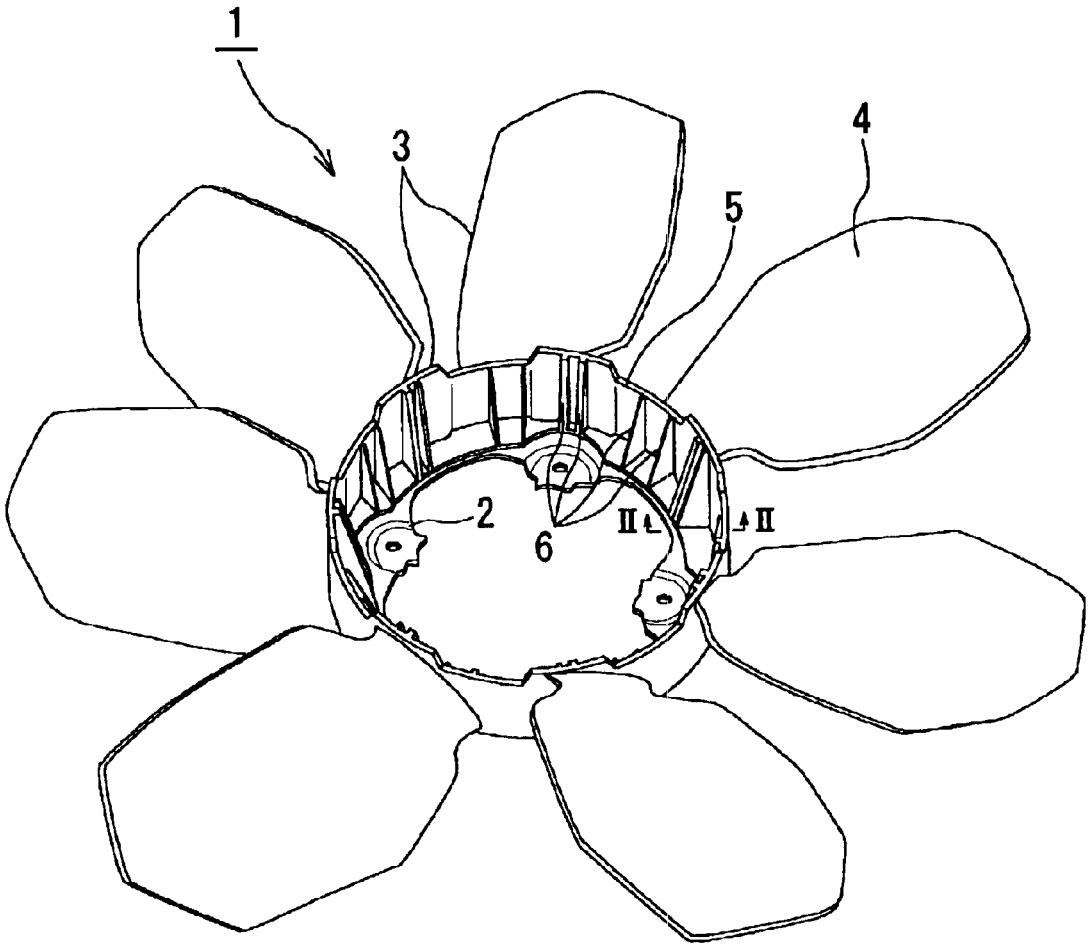
FIG. 1 is a perspective view showing an entire structure of a cooling fan according to a first embodiment of the invention.

Several embodiments of the invention are described hereunder referring to the attached drawings. The same reference characters are used to show the same elements throughout the several embodiments.

First Embodiment

Figure 2:
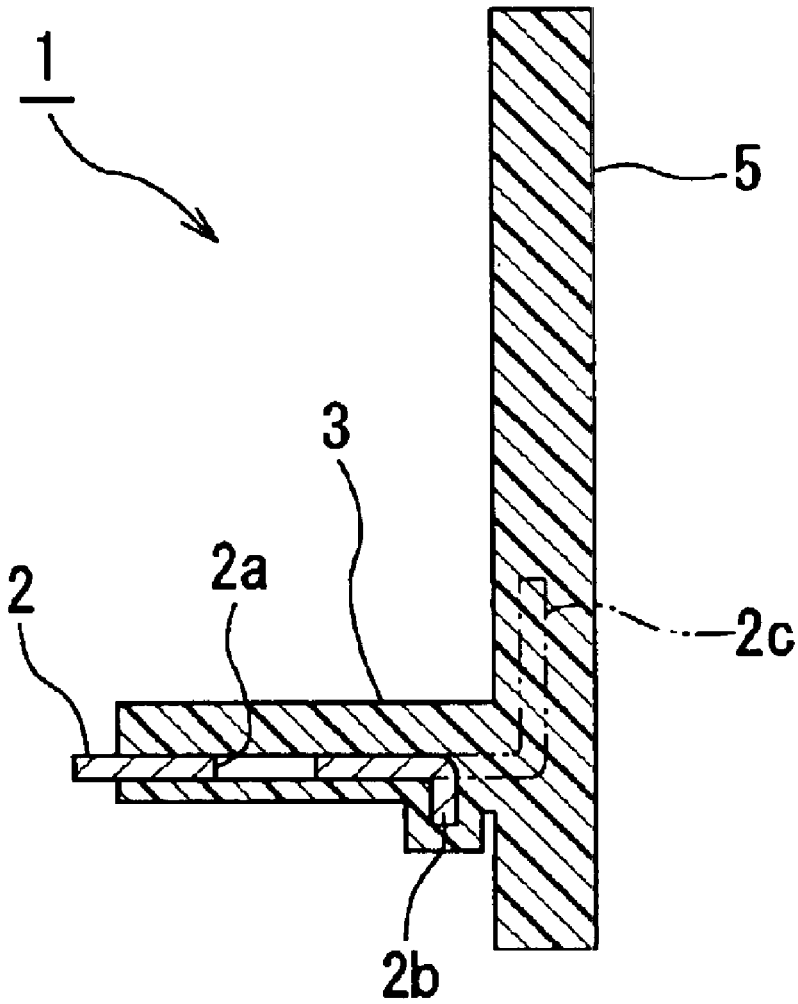
FIG. 2 is a cross-section taken along the line II—II of FIG. 1 and showing a spacer deep-drawn at a location more inside than a boss.
Figure 3:
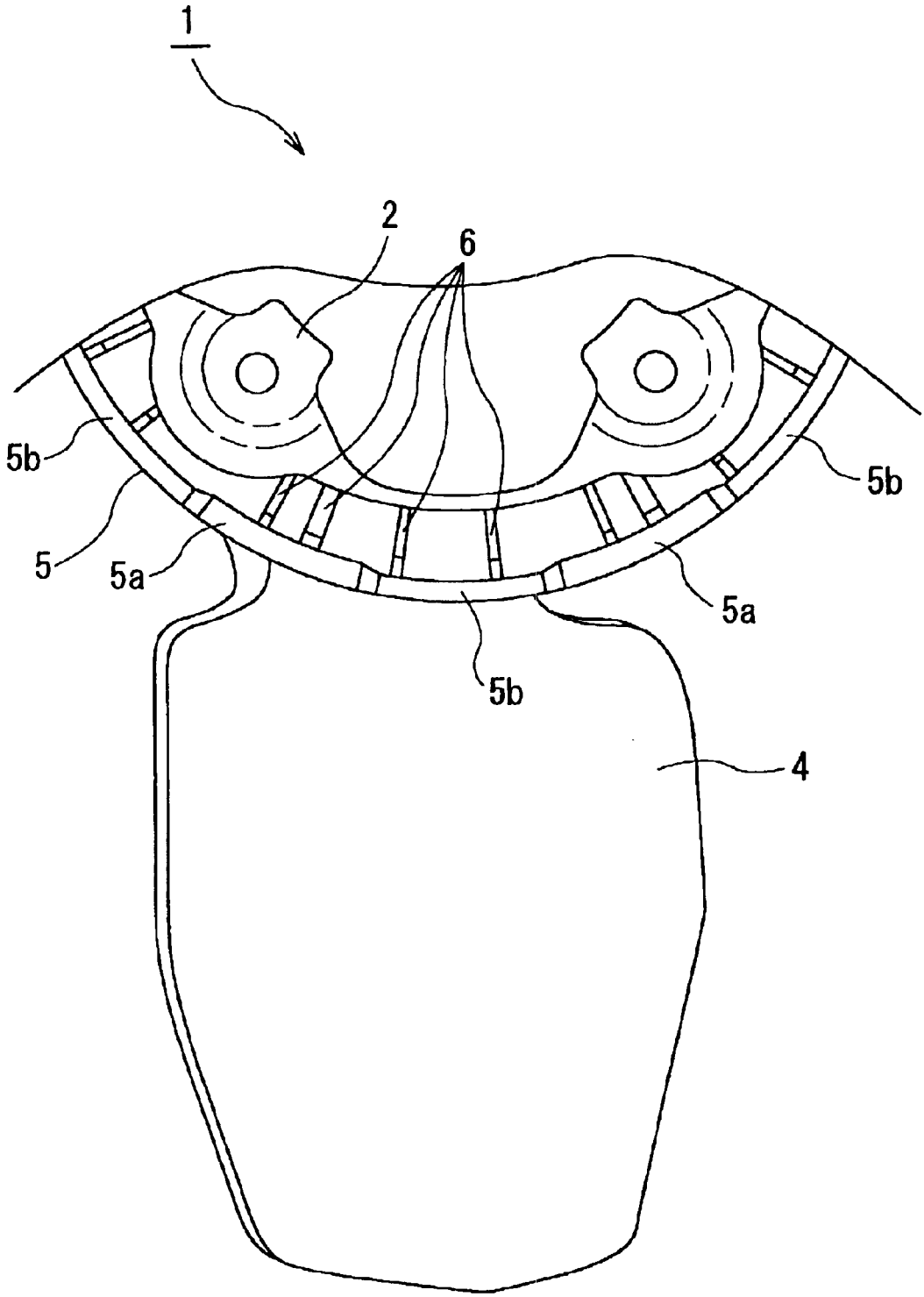
FIG. 3 is a partially enlarged top view showing a relation between a mounting position of a blade and a thickness of the boss according to the first embodiment of the cooling fan of the invention.
Figure 4:
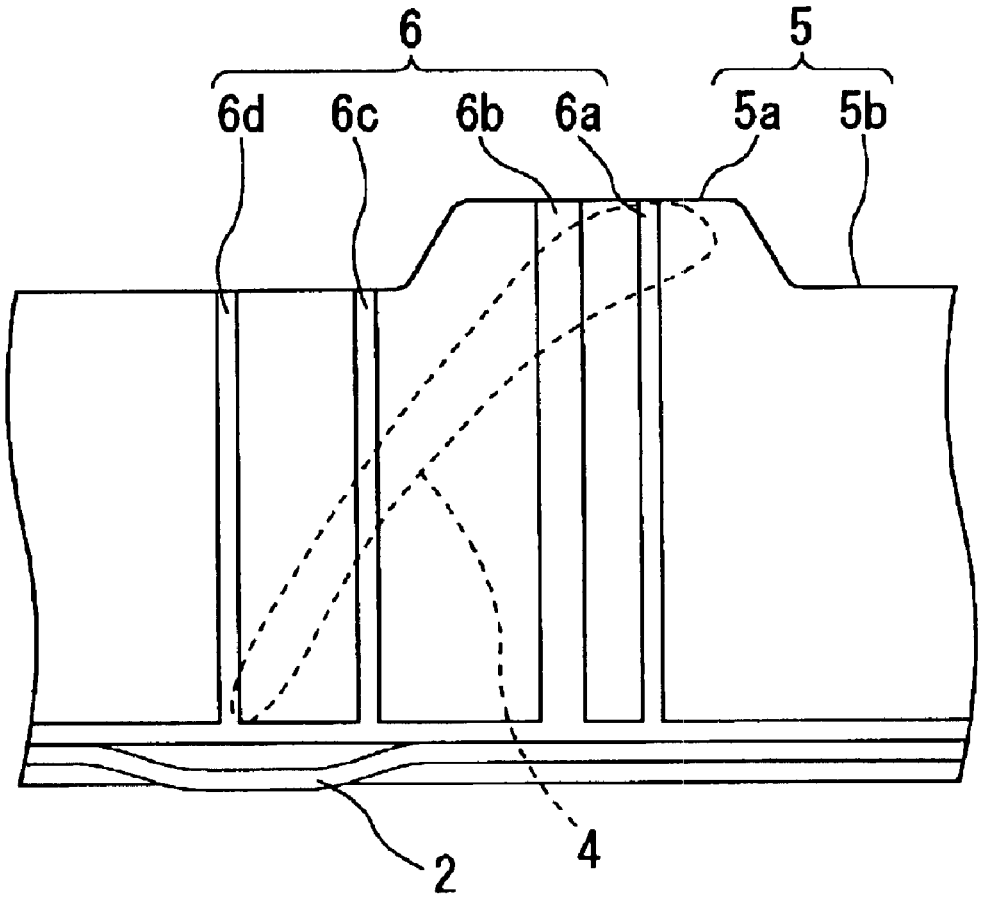
FIG. 4 is a partially enlarged inside view showing a relation between a mounting position of a blade and a thickness and an interval of inside ribs according to the first embodiment of the cooling fan of the invention.

A first embodiment of the invention is described referring to FIG. 1 to FIG. 4. FIG. 1 is a perspective view showing an entire structure of a cooling fan according to a first embodiment of the invention. FIG. 2 is a cross-section taken along the line II—II of FIG. 1 and showing a spacer deep-drawn at a location more inside than a boss. FIG. 3 is a partially enlarged top view showing a relation between a mounting position of a blade and a thickness of the boss according to the first embodiment of the cooling fan of the invention. FIG. 4 is a partially enlarged inside view showing a relation between a mounting position of a blade and a thickness and an interval of inside ribs according to the first embodiment of the cooling fan of the invention.

Referring to FIG. 1, the first embodiment of a cooling fan 1 has a metal spacer 2 of a ring shape and a resin molded portion 3 made of a plastic material. The spacer 2 has four mounting holes. The resin molded portion 3 is molded integrally with the spacer 2 as an insert. The resin molded portion 3 is composed of plural, e.g. seven blades 4 and a cylindrical boss 5 having an outer periphery to which the blades 4 are joined. The resin molded portion 3 further has plural ribs 6 formed along an inner periphery of the boss 5. An upper side in FIG. 1 is a front edge side of the blade 4 from which the air enters.

A connected structure of the spacer 2 and the resin molded portion 3 is described referring to FIG. 2. In a conventional cooling fan, the spacer 2 extends up to the boss 5 and has a deep-drawn part 2*c* formed in the boss 5 so as to be jointed with the resin molded portion 3 as shown by an imaginary line in FIG. 2. In contrast, the first embodiment of the cooling fan 1 has a deep-drawn part 2*b* before the boss 5 along an outer periphery of the boss 5 so as to provide joint between the spacer 2 and the resin molded portion 3. Consequently, the cooling fan 1 is capable of improving durability while saving material for the spacer 2 and decreasing the production costs. The spacer 2 has a part covered with the resin molded portion 3 where holes 2*a* are formed at certain intervals. Thereby, a plastic material of the resin molded portion 3 is held up in the holes 2*a* thereby reinforcing the joint, while saving the material and weight of the spacer 2.

As mentioned above, the present embodiment of the cooling fan 1 is capable of improving the durability while limiting a size of an outer circumference of the spacer 2 to a required or minimum dimension and reducing the costs.

Next, reinforcement of a mounting structure of the blade 4 on the outer periphery of the boss 5 is described referring to FIG. 3. The blade 4 is jointed to a front edge side 5*a* and a rear edge side 5*b* of the boss 5. Specifically, the blade has a front edge side jointed to the front edge side 5*a* and a rear edge side jointed to the rear edge side 5*b*. The front edge side 5*a* is formed higher than the rear edge side 5*b* in accordance with an inclination of the blade 4. As a result of an analysis by CAE (computer aided engineering), it was found that stress became the largest at the front edge side of the blade. Therefore, the boss 5 is bulged inwardly at the front edge side 5*a* near the front edge side of the blade 4 so that the front edge side 5*a* has a thickness larger than a thickness of the rear edge sides 5*b* in front thereof and at the rear thereof. Consequently, the boss 5 is reinforced at the front edge side 5*a* corresponding to the front edge side of the blade 4 on which the largest stress is applied, thereby improving the durability.

As mentioned above, the cooling fan 1 is capable of improving the durability while reducing the costs by making the thickness of the boss 5 large only at the necessary part 5*a*.

Referring to FIG. 4, next described is a relation between a thickness and an interval of ribs 6 at the inner periphery of the boss 5 and a mounting position of the blade on the outer periphery of the boss 5.

As shown in FIG. 4, it is a rib 6*b* near the front edge side of the blade 4 that has the largest thickness. The blade 4 is separated away from the boss 5 at a position of a rib 6*a*. Then, load or stress applied on the rib 6*a* is smaller than that applied on the rib 6*b*. Thus, the rib 6*a* is made thinner than the rib 6*b* but is capable of enduring the stress. Moreover, not so large stress is applied on a rib 6*c* and a rib 6*d* that are distant from the front edge side of the blade 4. Therefore, the rib 6*c* and the rib 6*d* are thinner than the rib 6*b*. The thicknesses of the ribs are changed according to a shape of the cooling fan. While only the rib 6*b* is made thick in FIG. 4, both the ribs 6*a* and 6*b* may be made thick, for example.

The interval is set wide at spaces between the rib 6*b* and the rib 6*c* and between the rib 6*c* and the rib 6*d* on which not so large stress is applied. The interval is set much narrower at a space between the rib 6*a* and the rib 6*b* that is the nearest to the front edge side of the blade 4. Thus, the thickness of the rib is made thick while the interval between the ribs is made narrow only at a portion on which the stress is applied. Consequently, the boss 5 is reinforced at the front edge side of the blade and improves its durability, while reducing the costs.

As mentioned above, the cooling fan 1 is capable of improving the durability while reducing the costs by making large the thickness of the ribs 6 at the inner periphery of the boss 5 only at the necessary part.

As described above, the first embodiment of the cooling fan 1 has the ring-shaped metal spacer 2, the boss 5 of substantially the cylindrical shape made of synthetic resin that is molded integrally with the spacer 2 as the insert and the plural blades 4 that extend outwardly from the boss 5. The deep-drawn part is provided on the outer circumferential part of the spacer 2 at the inside of the boss 5. The thickness of the boss 5 is made large at around the front end side of the blade 4 on which the largest stress is applied. The rib 6 at the inner periphery of the boss 5 at around the front end side of the blade is made thicker than the other ribs. Moreover, the interval at the space between that rib and the adjacent rib is made narrower. Thus, the outer circumference of the space 2 becomes small thereby to reduce the production costs. Moreover, the joint of the spacer 2 and the resin molded portion 3 becomes strong, thereby improving the durability. In addition, the front end side of the blade 4 and its adjacent part are reinforced while minimizing increase of volume of the boss 5 and the ribs 6, while decreasing the costs and improving the durability.

Second Embodiment

Figure 5:
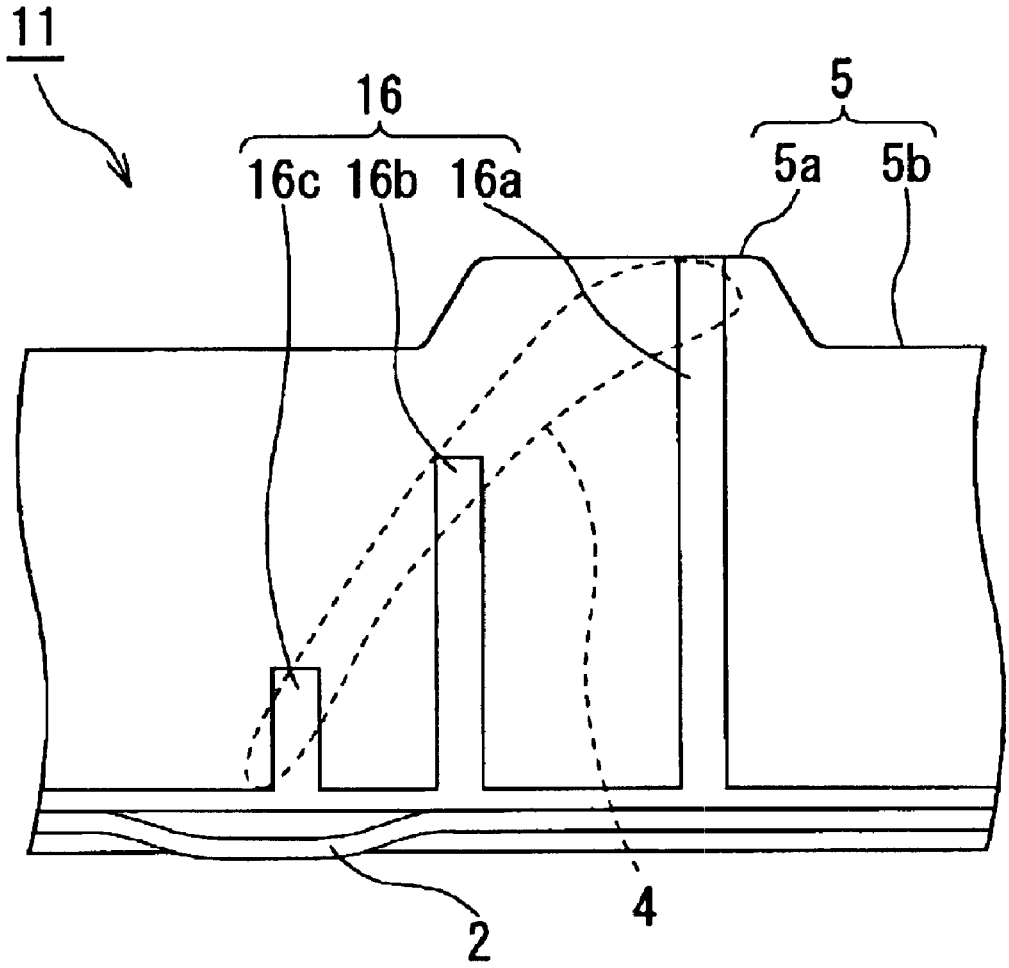
FIG. 5 is a partially enlarged inside view showing a relation between a mounting position of a height of inside ribs according to the second embodiment of a cooling fan of the invention.

A second embodiment of the invention is described referring to FIG. 5. FIG. 5 is a partially enlarged inside view showing a relation between a mounting position of a height of inside ribs according to the second embodiment of a cooling fan of the invention. A cooling fan 11 has the same structure as the first embodiment of the cooling fan 1 except the elements shown in FIG. 5.

As shown in FIG. 5, the second embodiment of the cooling fan 11 has three ribs 16*a*, 16*b* and 16*c* heights of which are changed respectively depending on the mounting position of the blade 4 on the outer periphery of the boss 5. Specifically, as a result of an analysis by CAE, it was found that stress was hardly applied on part of the rib 6 that was located above the blade or in front of the blade. Accordingly, the rib 16*a* has a height essentially equal to a height of the front edge side 5*a* of the boss 5, since the rib 16*a* is located at the rear of the front end part of the blade 4 and the largest stress is applied on the rib 16*a*. The rib 16*b* has a height essentially equal to a height of a mounting position of the blade 4, since the rib 16*b* is located at the rear of the middle part of the blade 4 and the stress is applied on the rib 16*b* to a certain degree. The rib 16*c* has a height essentially equal to a height of a mounting position of the blade 4, too, since the rib 16*c* is located at the rear of the back end part of the blade 4 and small stress is applied on the rib 16*c*. As mentioned above, the rib 16 has substantially the same height as the height of the mounting position of the blade 4, thereby eliminating the upper parts of the ribs 16 on which the stress is hardly applied. Thus, the cooling fan improves the durability while saving the material and reducing the costs.

As described above, the second embodiment of the cooling fan 11 has a deep-drawn part provided on the outer circumferential part of the spacer 2 at the inside of the boss 5. Moreover, the thickness of the boss 5 is made large at the part 5*a* around the front end side of the blade 4 on which the largest stress is applied. Furthermore, the heights of the ribs 16 at the inner periphery of the boss 5 are changed in accordance with the height of the mounting position of the blade 4. Thus, the outer circumference of the space 2 becomes small thereby to reduce the production costs. Moreover, the joint of the spacer 2 and the resin molded portion 3 becomes strong, thereby improving the durability. In addition, the front end side of the blade 4 and its adjacent part are reinforced while minimizing increase of volume of the boss 5 and the ribs 16, while decreasing the costs and improving the durability.

While the height of the ribs 6 is not changed in the first embodiment of the cooling fan 1. On the other hand, the thickness of the ribs 16 is essentially equal, while the interval between the ribs 16 are essentially equal. Then, it is possible to adopt all these improvements in the invention. That is, such inventive cooling fan has a deep-drawn part provided on the outer circumferential part of the spacer 2 at the inside of the boss 5. The thickness of the boss 5 is made large at around the front end side of the blade 4 on which the largest stress is applied. The rib 6 at the inner periphery of the boss 5 at around the front end side of the blade is made thicker than the other ribs. Moreover, the interval at the space between that rib and the adjacent rib is made narrower. Furthermore, the heights of the ribs 6 are changed in accordance with the height of the mounting position of the blade 4.

To the contrary, only one of the above improvements may be adopted in the cooling fan. Even such cooling fan is enough to realize the invention. That is, the inventive cooling fan may only have a deep-drawn part provided on the outer circumferential part of the spacer 2 at the inside of the boss 5. The inventive cooling fan may only make a thickness of the boss 5 large at around the front end side of the blade 4. The inventive cooling fan may only make the thickness of the rib 6 at the inner periphery of the boss 5 at around the front end side of the blade thicker than the other ribs. The inventive cooling fan may only make the interval at the space between that rib and the adjacent rib narrower than the other intervals. The inventive cooling fan may only change the heights of the ribs 6 in accordance with the height of the mounting position of the blade 4. Alternatively, two or more of the above improvements may be adopted for the inventive cooling fan.

The configuration, shape, number, material, dimension, jointing relation and so on of the other elements or parts of the cooling fan are not limited to those of each of the above embodiments.

The preferred embodiments described herein are illustrative and not restrictive, the scope of the invention being indicated in the appended claims and all variations which come within the meaning of the claims are intended to be embraced therein.

What is claimed is:

1. A cooling fan comprising:

a spacer of a ring shape made of a metal;

a boss of substantially a cylindrical shape made of a synthetic resin that is molded integrally with the spacer as an insert, the boss having opposite axial ends; and plural blades that extend outwardly from the boss;

the spacer having a deep-drawn part provided on an outer circumferential part thereof, the spacer being located at one of the opposite axial ends of the boss, while the deep-drawn part of the spacer being located at an inner position than an inner peripheral surface of the boss, the deep-drawn part being formed by bending the outer circumferential part of the spacer so as to extend from the outer circumferential part of the spacer in a direction going from an other axial end to the one end of the boss, the deep-drawn part of the spacer being located according to a mounting position of the blade.

2. A cooling fan comprising according to claim 1, further comprising:

A joint portion formed integrally on the inner peripheral surface of the boss so as to extend inwardly from the boss, the joint portion having a projection protruded from one thickness side thereof located at a side of the one axial end of the boss, the protrusion being protruded by a length less than a thickness of the joint portion;

the deep-drawn part of the spacer being located at the protrusion of the joint portion so as to extend toward an inside of the protrusion of the joint portion.

3. A cooling fan comprising:

a spacer of a ring shape made of a metal;

a boss of substantially a cylindrical shape made of a synthetic resin that is molded integrally with the spacer as an insert; and plural blades that extend outwardly from the boss;

the boss having a larger thickness part and a small thickness part arranged in a circumferential direction thereof, the large thickness part of the boss being located at an area in the circumferential direction thereof where a front edge side of the blade is located when seen in a plan view, while the small thickness part of the boss being located at an area in the circumferential direction thereof where another part than a front edge side of the blade is located when seen in a plan view.

4. A cooling fan comprising:

a spacer of a ring shape made of a metal;

a boss of substantially a cylindrical shape made of a synthetic resin that is molded integrally with the spacer as an insert;

plural blades that extend outwardly from the boss; and plural ribs provided on an inner periphery of the boss at intervals in a circumferential direction of the inner periphery of the boss, one or more of the ribs located at around a front edge side of the blade being thicker than other ribs according to a mounting position of the blade.

5. A cooling fan comprising: a spacer of a ring shape made of a metal; a boss of substantially a cylindrical shape made of a synthetic resin that is molded integrally with the spacer as an insert; plural blades that extend outwardly from the boss; and plural ribs provided on an inner periphery of the boss at intervals in a circumferential direction of the inner periphery of the boss, the ribs changing heights according to a mounting position of the blade at an outer periphery of the boss so that a rib located at a front edge side of the blade has a larger height than that of a rib located at a rear edge side of the blade, while the ribs being located within an area where the blade is located on the boss in the circumferential direction of the boss.

6. A cooling fan comprising: a spacer of a ring shape made of a metal;

a boss of substantially a cylindrical shape made of a synthetic resin that is molded integrally with the spacer as an insert;

plural blades that extend outwardly from the boss; and plural ribs provided on an inner periphery of the boss at intervals in a circumferential direction of the inner periphery of the boss, the interval between the ribs at a front edge side of the blade being narrower than the interval between the ribs at a side away from the front edge side of the blade according to a mounting position of the blade.

7. A cooling fan comprising:

a spacer of a ring shape made of a metal;

a boss of substantially a cylindrical shape made of a synthetic resin that is molded integrally with the spacer as an insert, the boss having opposite axial ends;

plural blades that extend outwardly from the boss; and plural ribs provided on an inner periphery of the boss at intervals in a circumferential direction of the inner periphery of the boss;

the cooling fan further comprising two or more of following features:

the spacer having a deep-drawn part provided on an outer circumferential part thereof, the spacer being located at one of the opposite axial ends of the boss, while the deep-drawn part of the spacer being located at an inner position than an inner peripheral surface of the boss, the deep-drawn part being formed by bending the outer circumferential part of the spacer so as to extend from the outer circumferential part of the spacer in a direction going from an other axial end to the one end of the boss, the deep-drawn part of the spacer being located according to a mounting position of the blade;

the boss having a large thickness part and a small thickness part arranged in a circumferential direction thereof, the large thickness part of the boss being located at an area in the circumferential direction thereof where a front edge side of the blade is located when seen in a plan view, while the small thickness part of the boss being located at an area in the circumferential direction thereof where another part than a front edge side of the blade is located when seen in a plan view;

one or more of the ribs located at around a front edge side of the blade being thicker than other ribs according to a mounting position of the blade;

the ribs changing heights according to a mounting position of the blade at an outer periphery of the boss so that a rib located at a front edge side of the blade has a larger height than that of a rib located at a rear edge side of the blade, while the ribs being located within an area where the blade is located on the boss in the circumferential direction of the boss; and the interval between the ribs at a front edge side of the blade being narrower than the interval between the ribs at a side away from the front edge side of the blade according to a mounting position of the blade.

* * * * *